US006119863A

United States Patent [19]

Lofgren et al.

[11] Patent Number: 6,119,863

[45] Date of Patent: Sep. 19, 2000

[54] SUSPENSION PACKAGE

[75] Inventors: Lewis C. Lofgren; Fred Vega, both of Chicago; Noel M. Phillips, Clarendon Hills, all of Ill.

[73] Assignee: ADE, Inc., Chicago, Ill.

[21] Appl. No.: 09/483,771

[22] Filed: Jan. 18, 2000

[51] Int. Cl.[7] ..... B65D 85/30

[52] U.S. Cl. ..... 206/583; 206/591

[58] Field of Search ..... 206/521, 583, 206/586, 591, 594

[56] References Cited

U.S. PATENT DOCUMENTS 4,606,459 8/1986 Luray .
4,606,460 8/1986 Luray .
5,056,665 10/1991 Boecker et al. .
5,579,917 12/1996 Lofgren et al. ..... 206/583
5,669,506 9/1997 Lofgren et al. ..... 206/583
5,823,348 10/1998 Phillips et al. .
5,894,932 4/1999 Harding et al. .

*Primary Examiner*—Jacob K. Ackun
*Attorney, Agent, or Firm*—Brinks Hofer Gilson & Lione

[57] ABSTRACT

A suspension package includes end panels that are pivotably mounted to a base at opposite ends of the base. A product restraint such as a hammock is stretched across the end panels, and side panels are pivoted to the base on respective sides of the product restraint. At least one of the side panels includes an upper panel that can be moved into position between the end panels to hold the end panels substantially at right angles with respect to the base and to maintain the product restraint in tension, thereby suspending a packaged product contained in the product restraint above the base and between the end panels. The side panels can be configured to perform this holding function, either along with the upper panel or instead of the upper panel.

17 Claims, 3 Drawing Sheets

SUSPENSION PACKAGE

BACKGROUND

This invention relates to suspension packages of the type that suspend a packaged product within an outer container.

Suspension packages of this general type are known to the art and have met with considerable commercial success. See, for example, the suspension packages of U.S. Pat. Nos. 4,606,459, 4,606,460, 5,056,665, 5,579,917, 5,669,506, 5,823,348, and 5,894,932, all assigned to the assignee of the present invention. The suspension package shown in U.S. Pat. No. 4,606,459 includes fixed side and end walls that extend upwardly from a base. A tensor panel is pivotably mounted to each end wall, and a product restraint such as a hammock extends between the tensor panels. By rotating the tensor panels outwardly, the product restraint is tensioned.

U.S. Pat. No. 5,056,665 discloses a suspension package that is in many ways similar to that described above. In order to increase the strength of the fixed end panels, a brace is positioned to extend between the end panels adjacent the base.

The suspension package shown in U.S. Pat. No. 5,669,506 includes end walls that are fixed at a desired angle with respect to the base, and a product restraint such as a hammock that is tensioned between the end walls. In this case, the base is creased such that the two halves of the base can be pivoted toward one another about this crease to bring the end walls closer together and to relieve tension on the product restraint.

SUMMARY

The preferred embodiments described below provide a one-piece suspension package that does not require the use of an external package. In these embodiments, the product restraint is stretched between two end walls that are joined to the base at respective fold lines. The end walls are free to pivot toward one another to relieve tension on the product restraint and to facilitate product loading. Side walls are connected to the base at respective fold lines, and at least one of the side walls includes an upper panel positioned to move between the end walls when in a closed position. In this position the upper panel extends as a brace in compression between the end walls, thereby holding the end walls parallel to one another and maintaining tension on the product restraint. The side panels can also act as a brace between the end panels, either in addition to the upper panel or in substitution for the upper panel.

The foregoing paragraph is intended by way of general introduction, and it is not intended to limit the scope of the following claims.

DETAILED DESCRIPTION OF THE PRESENTLY PREFERRED EMBODIMENTS

Figure 1:
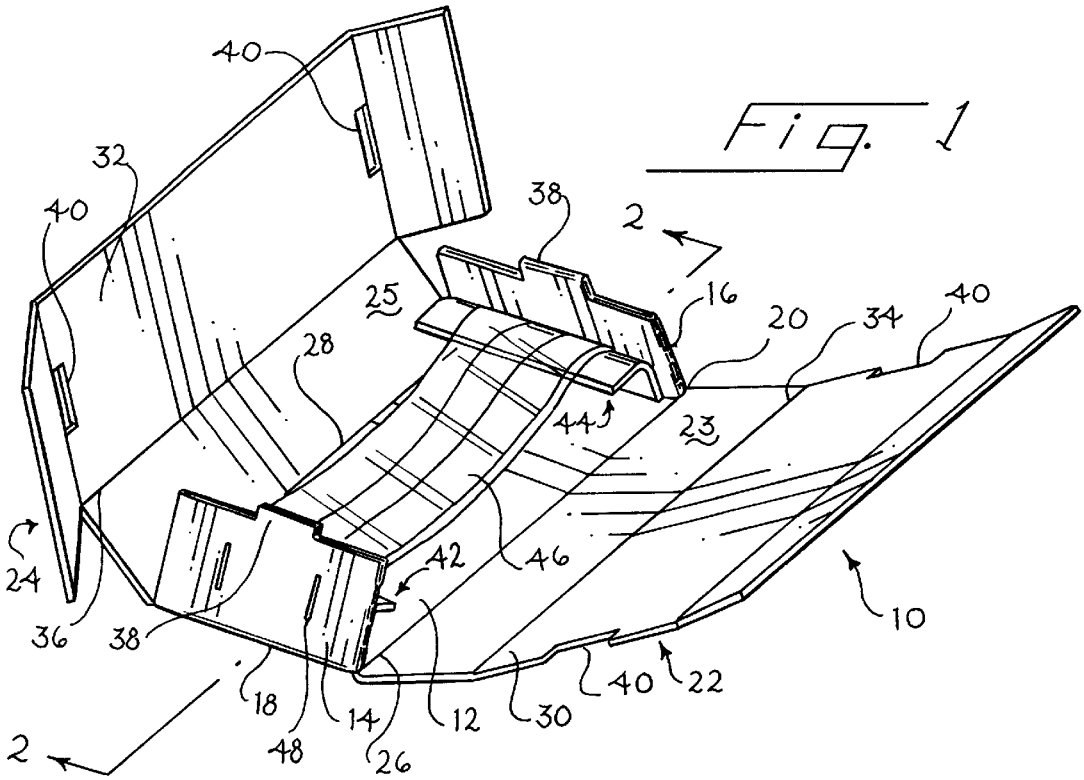
FIG. 1 is a perspective view of a first preferred embodiment of the suspension package of this invention in an open position.

Turning now to the drawings, FIG. 1 shows a suspension package 10 that incorporates a preferred embodiment of this invention. Though the package 10 can be made from many materials, in this example it is made from corrugated paperboard.

The package 10 includes a base 12 that is connected to first and second end panels 14, 16 at first and second pivot axes 18, 20, respectively. Similarly, the base 12 is connected to first and second side panels 22, 24 at first and second pivot axes 26, 28, respectively. By way of example, the pivot axes 18, 20, 26, 28 may be formed by respective fold lines, creases or score lines. The first side panel 22 includes a first lower portion 23 and a first upper panel 30, and the second side panel 24 includes a second lower portion 25 and a second upper panel 32. Lower portions 23, 25 of the panels 22, 24 are connected to the panels 30, 32 at fold lines 34, 36, respectively. In this embodiment, each of the end panels 14, 16 defines an upwardly facing tab 38, and each of the upper panels 30, 32 defines two correspondingly situated notches 40. As used herein, the term "notch" is intended broadly to encompass a notch that is partially open as shown in the first upper panel 30, or a notch that is fully closed as shown in the second upper panel 32.

The container 10 includes spacing panels 42, 44 that extend in part alongside the respective end panels 14, 16 and in part away from the respective end panels 14, 16. A product restraint 46 is secured to the first and second end panels 14, 16 to extend therebetween. The product restraint 46 can take the form of a hammock including a polymer film arranged in a C-fold that substantially encloses a packaged product, as described in any of the above referenced U.S. Patents. In this embodiment, staples 48 secure the spacing panels 42, 44 and the product restraint 46 to the end panels 14, 16.

In this embodiment, the end panels 14, 16 function as supports for the product restraint 46. The spacing between the end panels 14, 16 adjacent the base 12 is fixed by the base 12, which in this embodiment is substantially rigid and free of internal creases. However, the end panels 14, 16 are free to pivot with respect to the base 12, and the tension on the product restraint 46 is determined by the angles formed between the end panels 14, 16 and the base 12. When the end panels 12, 14 are angled toward one another, the tension on the product restraint 46 is less than when the end panels 14, 16 are positioned parallel to one another.

FIG. 1 shows the side panels 22, 24 and the upper panels 30, 32 in an open, or loading position. In this position, the end panels 14, 16 are free to move toward one another, thereby relaxing tension on the product restraint 46 and facilitating the loading of a product being packaged into the product restraint 46.

Figure 2:
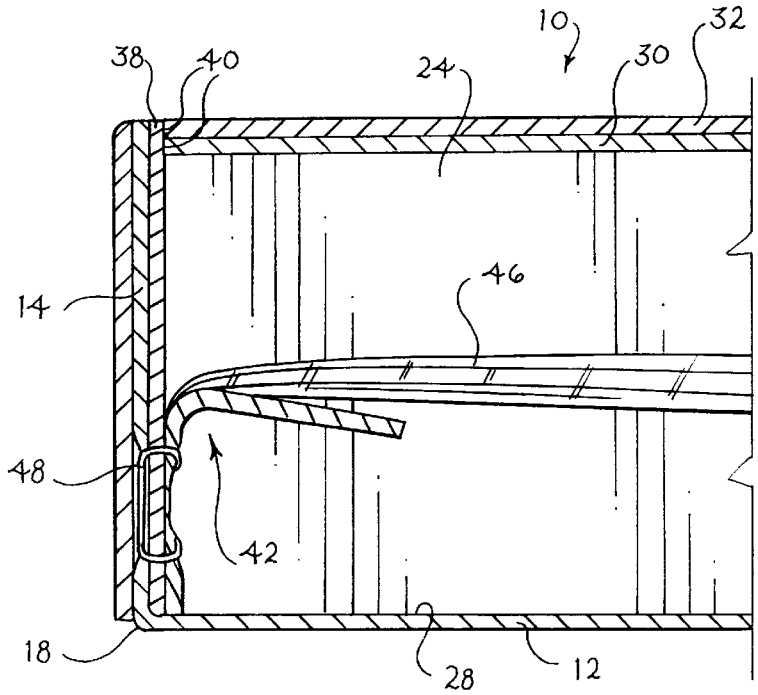
FIG. 2 is a longitudinal sectional view taken along line 2—2 of the embodiment of FIG. 1 in a closed position.

Once the product being packaged has been loaded into the product restraint 46, the side panels 22, 24 and the upper panels 30, 32 can be moved to the closed position shown in FIG. 2. In this closed position, the upper panels 30, 32 receive the tabs 38 in the notches 40, and the upper panels 30, 32 extend between the end panels 14, 16, functioning as braces in compression. In this position of the upper panels 30, 32 (sometimes identified as the tensioning position), the upper panels 30, 32 hold the end panels 14, 16 at right angles to the base 12 and parallel to one another, and thereby maintain the product restraint 46 in tension.

The package 10 provides the advantage of suspending the packaged product in the product restraint 46, spaced from the base 12, the end panels 14, 16, the side panels 22, 24, and the upper panels 30, 32. The spacing panels 42, 44 reduce any tendency of the packaged product to slide in the product restraint 46 into contact with one of the end panels 14, 16.

The cost, complexity and size of the suspension package 10 are minimized because the base 12, the side panels 22, 24, and one of the upper panels 30, 32 form outer surfaces of a package suitable for shipping. Thus, in many embodiments no external box or other container is required for the suspension package 10. The product can readily be loaded into the product restraint 46, because the side panels 22, 24 and the upper panels 30, 32 provide excellent access to the product restraint 46 when in the open position. The upper panels 30, 32 in the tensioning position form a brace that resists any tendency of the end panels 14, 16 to move toward one another and thereby remove tension from the product restraint 46.

Figure 3:
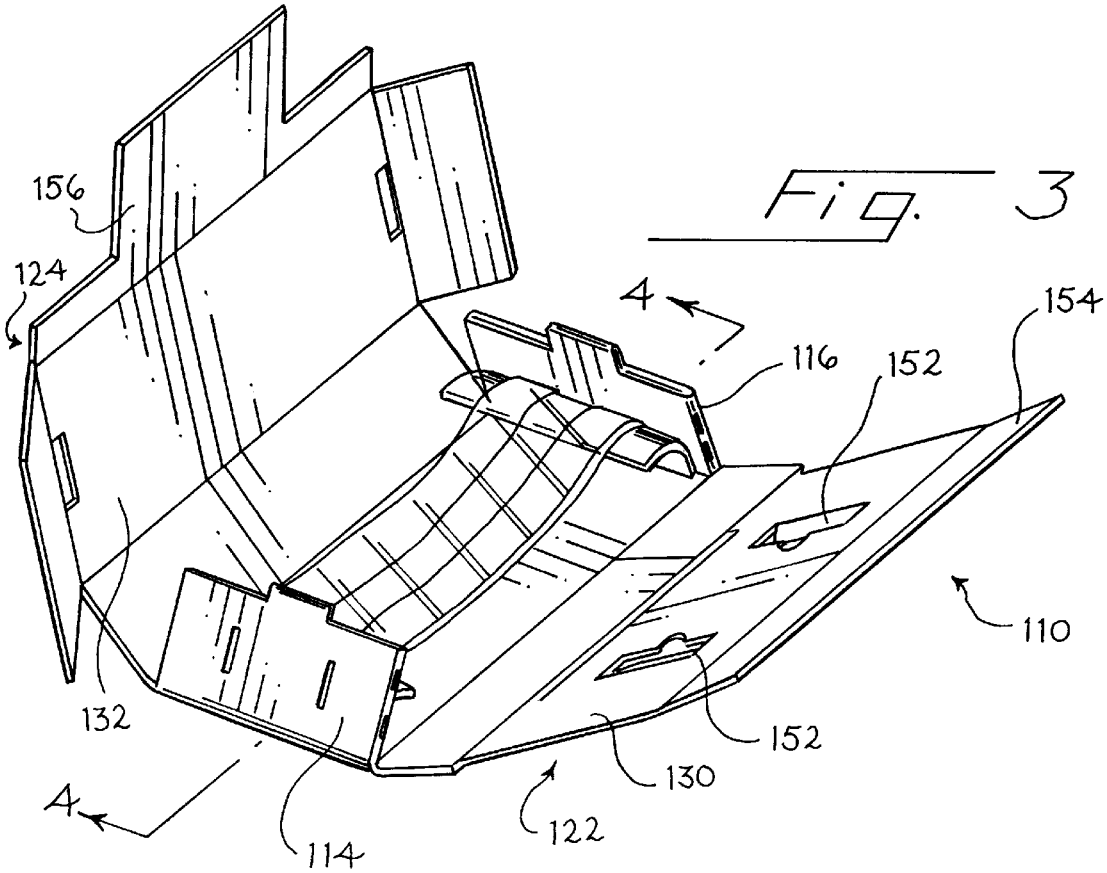
FIG. 3 is a perspective view of a second preferred embodiment of the suspension package of this invention in an open position.
Figure 4:
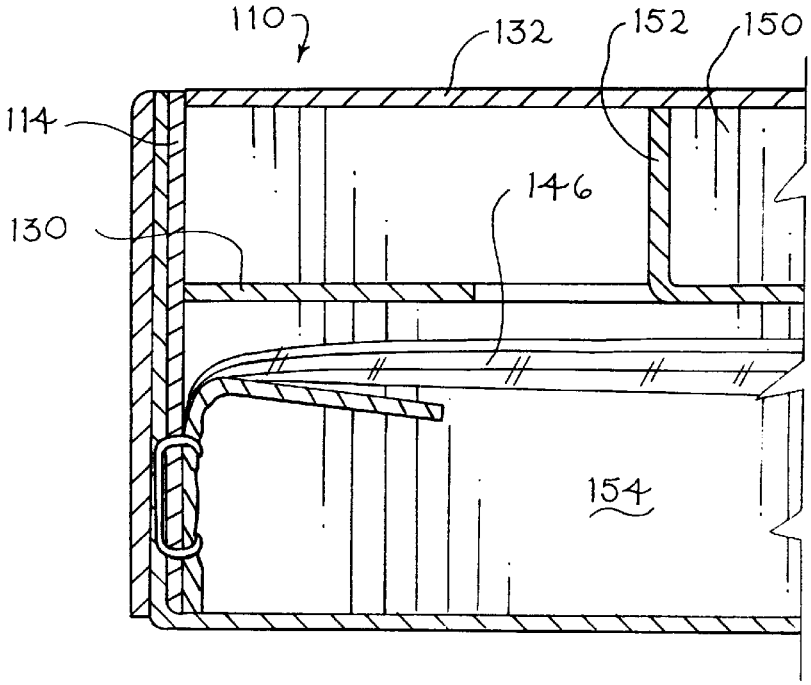
FIG. 4 is a longitudinal sectional view taken along line 4—4 of the embodiment of FIG. 3 in a closed position.

FIGS. 3 and 4 relate to a second preferred embodiment of this invention, which is similar to the first preferred embodiment in many respects. Corresponding elements of this first and second embodiment have been identified with the same reference numerals in the last two digits.

A principal difference between the suspension packages 10, 110 relates to the arrangement of the side panels 122, 124 and the upper panels 130, 132. In the package 110, the side panels 122, 124 are dimensioned such that the upper panels 130, 132 are separated by a gap when in the closed position to form a storage compartment 150 therebetween. The upper panel 130 is provided with two tabs 152 that are bent out of the plane of the upper panel 130 toward the upper panel 132. The tabs 152 prevent a product located in the storage compartment 150 from sliding toward or away from the end panels 114, 116. The panels 154, 156 attached to the upper panels 130, 132, respectively, assist in positioning the upper panels 130, 132 in the desired planes to define the storage compartment 150 therebetween.

Figure 5:
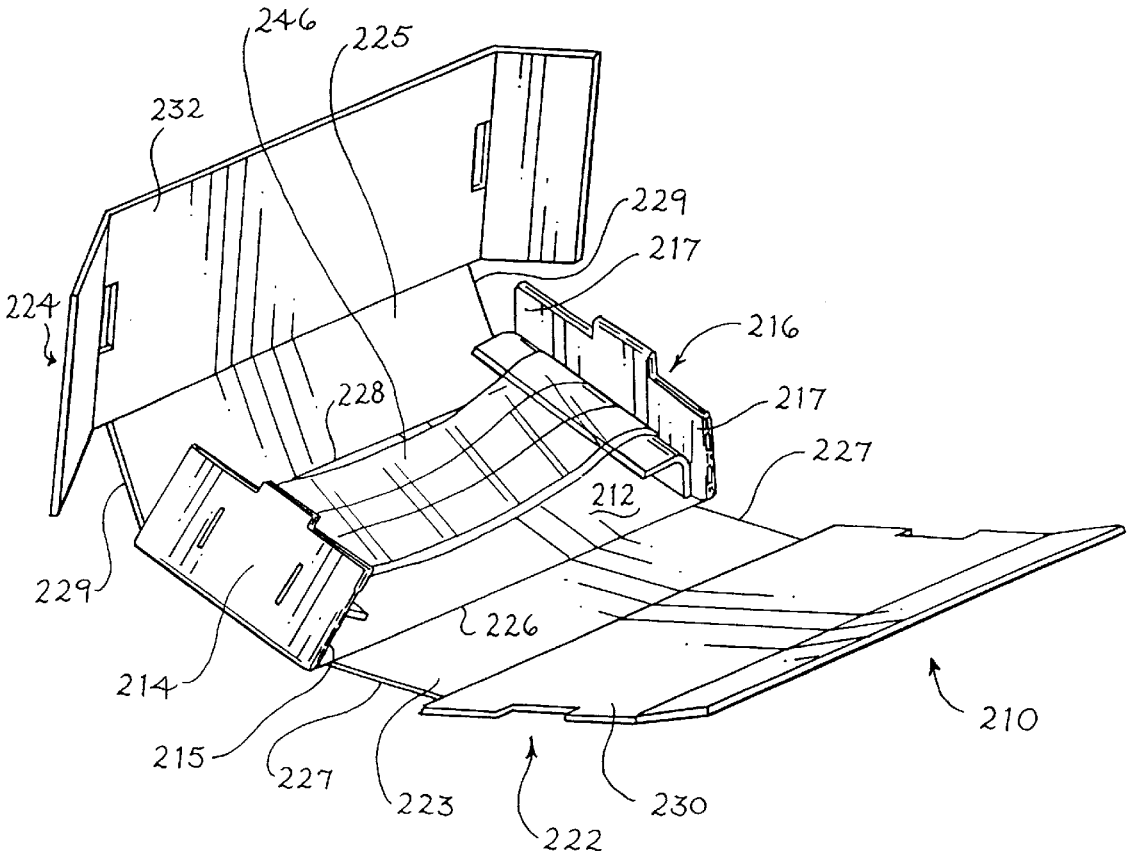
FIG. 5 is a perspective view of a third preferred embodiment of the suspension package of this invention in an open position.

FIG. 5 relates to a third preferred embodiment which is also quite similar to the first preferred embodiment described above. Corresponding elements of the first and third embodiments have been identified with the same reference numerals in the last two digits.

The main difference between the suspension packages 10, 210 relates to the arrangement of the lower portions 223, 225 of the side panels 222, 224. As before, FIG. 5 shows the side panels 222, 224 in the open or loading position. In the package 210 the lower portions 223, 225 are somewhat shorter than the corresponding portions of the package 210, and the fold lines 226, 228 are positioned somewhat closer together than in the package 10. With this arrangement, the lower portions 223, 225 fit between the end panels 214, 216 when the lower portions 223, 225 are folded along the fold lines 226, 228 to a closed or tensioning position transverse to the base 212. In this position, the edges 227, 229 of the lower portions 223, 225 bear on corresponding surfaces 215, 217 of the end panels 214, 216, respectively. In the tensioning position, the lower portions 223, 225 act as braces in compression to hold the end panels 214, 216 at right angles to the base 212 and parallel to one another, and thereby to maintain the product restraint 246 in tension.

In the package 210, the upper panels 230, 232, provide additional braces tending to hold the end panels 214, 216 at right angles to the base 212 and parallel to one another. It should be understood that in alternative embodiments the upper panels 230, 232 may be deleted, or they may alternatively extend above the end panels 214, 216 without engaging the end panels 214, 216. In this alternative (not shown), it is the lower portions 223, 225 alone that retain the end panels 214, 216 in the perpendicular position and the product restraint 246 under tension.

The suspension packages 10, 110, 210 can be secured in the closed position with shipping tape, cord, string or the like, and the suspension packages 10, 110, 210 can form the shipping package.

Of course, it should be understood that many changes and modifications can be made to the preferred embodiments described above. Any suitable material including paperboard, corrugated paperboard, plastics, fiberboard, metals and the like can be used to form the packages 10, 110, 210. In the illustrated embodiments, all of the panels except for the spacing panels 42, 44, 142, 144 are formed from a single sheet of material that is simply folded along designated fold or score lines to provide the finished suspension package. This simplifies assembly and reduces cost. In other embodiments multiple pieces can be separately fabricated and then assembled to provide a complete suspension package. Frames or other perforated structures may be substituted for the illustrated panels. The end panels may be formed from two component panels that are secured together to form a double thickness panel, as shown in FIGS. 2 and 4.

The packages 10, 110, 210 use product restraints 46, 146, 246 formed of a film folded into a C-shape in cross-section that is stapled to the respective end panel at each end. In alternate embodiments other materials, other geometries and even nets can be used as appropriate for the particular application. Other arrangements can be used to secure the product restraint in place.

In the embodiments described above, the braces that prevent the end panels from moving toward one another are formed by upper panels that are secured to one of the side panels, or by the side panels themselves. In alternative embodiments only a single upper panel can be used, or the brace can be mounted differently than as shown. For example, the brace can be pivotably mounted to one end panel to move between a tensioning position, in which the brace contacts the opposed end panel, and a loading position, in which the brace is pivoted away from the opposed end panel. In other arrangements, the brace can be mounted independently of both the end panels and the side panels.

Many other variations are possible. For example, the end panels can be shaped as tubular beams to provide increased strength, as described in U.S. Pat. No. 5,894,932. Also, the brace or braces between the end panels can extend over only a portion of the width of the end panels. In one alternative, two braces are provided, each extending in the same plane over about one-half of the width of the end panels when in the bracing position.

Additionally, the base 12 and the side panels 22, 24 may be provided with a central crease or score line to facilitate assembly and use, as described in U.S. Pat. No. 5,669,506. The tabs 38 may be eliminated, or alternatively multiple tabs may be provided on each end panel. The end flaps on the upper panel 32 may be configured to fit between the end panels 14, 16, above the product restraint 46. The spacing panels 42, 44 may be eliminated or oriented entirely parallel to the end panels, rather than extending toward the center of the product restraint 46.

As used herein, the term "position" is intended broadly to encompass a range of positions. Thus, any of a range of positions can correspond to the open position and the loading position described above.

The foregoing detailed description has described only a few of the many forms that this invention can take. For this reason, this detailed description is intended by way of illustration, not limitation. It is only the following claims, including all equivalents, that are intended to define the scope of this invention.

What is claimed is:

1. A suspension package comprising:

a base;

first and second supports secured to the base and extending away from a first side of the base;

a product restraint mounted to extend between the supports; and a brace removably positioned in a tensioning position in which the brace extends between the supports to tension the product restraint, said product restraint disposed between the brace and the base and spaced from the base when the brace is in the tensioning position;

said brace movable to a loading position, in which the brace is spaced from at least one of the supports to reduce tension on the product restraint.

2. The invention of claim 1 wherein the supports are each mounted to the base at a respective pivot joint such that the supports are free to move relative to the base toward one another to reduce tension on the product restraint when the brace is moved to the loading position.

3. The invention of claim 1 further comprising:

first and second side panels secured to the base, said first side panel comprising the brace, said side panels positioned to move between an open position in which the brace is in the loading position and the product restraint is at reduced tension, and a closed position, in which the brace is in the tensioning position and the side panels extend on both sides of the product restraint.

4. The invention of claim 3 wherein the second side panel comprises an upper panel positioned to overlie the brace when the side panels are in the closed position.

5. The invention of claim 4 wherein the second side panel is configured to form a storage compartment between the upper panel and the brace when the side panels are in the closed position.

6. The invention of claim 1 wherein the brace comprises first and second notches, each notch sized to receive a portion of a respective one of the supports when the brace is in the tensioning position.

7. The invention of claim 6 wherein the notches are sized to receive respective tabs extending upwardly from the supports.

8. The invention of claim 1 wherein the base is substantially rigid between the supports to maintain a substantially constant separation between the supports at the base.

9. The invention of claim 1 further comprising:

first and second spacing panels secured to the first and second supports, respectively, adjacent the product restraint, said spacing panels positioned between the product restraint and the base.

10. A suspension package comprising:

a container comprising a base, two opposed end panels extending away from the base, two opposed side panels extending away from the base, one of the side panels comprising an upper panel positioned to extend across the end panels;

a product restraint mounted to extend between the end panels within the container;

said upper panel braced between the end panels to tension the product restraint and to support the end panels against movement toward one another.

11. The invention of claim 10 wherein each end panel is connected to the base at a respective fold line, wherein each side panel is connected to the base at a respective fold line, and wherein the side panels are movable away from the end panels to provide access to the product restraint.

12. The invention of claim 11 wherein movement of said one of the side panels away from the end panels moves the upper panel away from the end panels to reduce tension on the product restraint.

13. The invention of claim 10 wherein the other of the side panels comprises a second upper panel positioned to extend across the end panels, said upper panels spaced from one another to form a storage compartment therebetween, said product restraint positioned between the storage compartment and the base.

14. A suspension package comprising:

a base;

first and second supports secured to the base and extending away from a first side of the base;

a product restraint mounted to extend between the supports; and a pair of braces removably positioned in a tensioning position in which the braces extend between the supports to tension the product restraint, said braces disposed alongside the product restraint, each of the braces disposed on a respective side of the product restraint;

said braces movable to a loading position, in which the braces are spaced from at least one of the supports to reduce tension on the product restraint.

15. The invention of claim 14 wherein the supports are each mounted to the base at a respective pivot joint such that the supports are free to move relative to the base toward one another to reduce tension on the product restraint when the braces are moved to the loading position.

16. The invention of claim 14 wherein the braces comprise first and second side panels secured to the base, said side panels positioned to move between an open position in which the braces are in the loading position and the product restraint is at reduced tension, and a closed position, in which the braces are in the tensioning position and the side panels extend on both sides of the product restraint.

17. The invention of claim 14 wherein the base is substantially rigid between the supports to maintain a substantially constant separation between the supports at the base.

* * * * *